United States Patent [19]

Matsuguchi et al.

[11] Patent Number: 5,005,874

[45] Date of Patent: Apr. 9, 1991

[54] POSTCARD AND ITS MANUFACTURING METHOD

[75] Inventors: Noboru Matsuguchi; Tadashi Matsuguchi, both of Suita, Japan

[73] Assignee: Daimatsu Kagaku Kogyo Co., Ltd., Osaka, Japan

[21] Appl. No.: 245,884

[22] Filed: Sep. 16, 1988

[30] Foreign Application Priority Data

Sep. 18, 1987 [JP] Japan ..... 62-235332
Sep. 18, 1987 [JP] Japan ..... 62-235333
Sep. 18, 1987 [JP] Japan ..... 62-235334

[51] Int. Cl.[5] ..... B42D 15/00

[52] U.S. Cl. ..... 283/101; 283/105; 283/901; 283/903

[58] Field of Search ..... 283/101, 105, 901, 903

[56] References Cited

U.S. PATENT DOCUMENTS 3,854,229 12/1974 Morgan ..... 283/101 X
3,891,242 6/1975 Arnold et al. ..... 283/901 X
3,900,219 8/1975 D'Amato et al. ..... 283/105 X
3,930,673 7/1976 Sanden ..... 283/105
4,273,362 6/1981 Carrier et al. ..... 283/903 X
4,674,771 6/1987 Thompson, II ..... 283/901 X
4,872,707 10/1989 De Bruin .

FOREIGN PATENT DOCUMENTS 54-3789 2/1979 Japan .

*Primary Examiner*—Paul A. Bell
*Attorney, Agent, or Firm*—Jordan and Hamburg

[57] ABSTRACT

This postcard includes a postcard material and a label covering at least part of the postcard material, and the label in turn, includes a top material at least partly opaque, an inter-layer peel ply formed on the principal surface of the top material, a synthetic resin layer at least partly transparent formed on the principal surface of the inter-layer peel ply and an adhesive layer formed on the principal surface of the synthetic resin layer and which is transparent in the part corresponding to the transparent part of the synthetic resin layer. With this postcard the top material of the label can be easily peeled off the synthetic resin layer in the part where the interlayer peel ply is formed. Secret information shown on the principal surface of the postcard material is visible through the transparent synthetic resin layer when the top material is peeled off the synthetic resin layer.

3 Claims, 6 Drawing Sheets

POSTCARD AND ITS MANUFACTURING METHOD

BACKGROUND OF THE INVENTION

1. Field of the Invention

The present invention relates to a special kind of postcard with a part thereof invisible, more particularly to a postcard secret information is kept covered during mailing and the recipient can see it at his own discretion, and a method of manufacturing it.

2. Description of the Prior Art

Recently, mail containing secret information such as the balance of a person's bank deposit has been increasing. It has, therefore, been desired to develop a postcard, a part of which containing secret information is kept covered during mailing, but which the recipient can see without difficulty. Japanese Utility Model Publication No. 3789/'79 discloses a post card, of which a part, for instance, a marked part is kept covered until it is uncovered by the recipient to see the secret information hidden thereunder.

To make it partly viewable, however, as seen from the text of the aforementioned Japanese Utility Model Publication No. 3789/'79, the entire surface of a covering paper has to be coated with a drying paste to form an adhesive film and the postcard material is partly, for instance, coated with a silicone release agent or the like so that the covering paper can be partly removed. Thus, since the covering paper has to be coated with a drying paste and the postcard material has to be partly treated with a release agent such as one based on silicone, the construction of such postcard becomes inevitably complicated and the increased number of manufacturing steps results in an increased manufacturing cost.

SUMMARY OF THE INVENTION

Therefore, it is a principal object of the present invention to provide a postcard, in which surface treatment of the postcard material is not required.

A first embodiment relates to a postcard composed of a postcard material and a label comprising a top material at least partly opaque, an inter-layer peel ply formed on the principal surface of the top material, a synthetic resin layer formed on the principal surface of an inter-layer peel ply and which is at least partly transparent and an adhesive layer formed on the principal surface of the synthetic resin layer and which is transparent in the part corresponding to the transparent part of the synthetic resin layer.

A second embodiment relates to a method of manufacturing such post-card consisting of a step of printing or coating picture lines on a postcard material, a process of manufacturing a label comprising steps (A) to (E), namely (A) a step of preparing a top material which is at least partly opaque, (B) a step of preparing a synthetic resin film or sheet for forming a synthetic resin layer which is at least partly transparent, (C) a step of forming on one principal surface of the synthetic resin film or sheet an adhesive layer which is transparent in the part corresponding to the transparent part of the synthetic resin film or sheet, (D) a step of printing or coating an inter-layer release agent on one principal surface of the top material or the synthetic resin film or sheet and (E) a step of forming an inter-layer peel ply between the top material and the synthetic resin layer formed of the synthetic resin film or sheet by laminating the synthetic resin film or sheet on the top material using the inter-layer release agent, and a step of sticking the label with its adhesive layer side to the picture lines part of the postcard material.

A third embodiment relates to another method of manufacturing such postcard consisting of a step of printing or coating picture lines on a postcard material, a process of manufacturing a label comprising the steps (A) to (D), namely (A) a step of preparing a top material which is at least partly opaque, (B) a step of forming an inter-layer peel ply by printing or coating a release agent on the principal surface of the top material, (C) a step of forming a synthetic resin layer which is at least partly transparent by printing or coating a synthetic resin agent on the principal surface of the inter-layer peel ply and (D) a step of forming an adhesive layer on the surface of the synthetic resin layer, this adhesive layer being transparent in the part corresponding to the transparent part of the synthetic resin layer, and a step of sticking the label with its adhesive layer side to the picture lines part of the postcard material.

According to the present invention, the label has the inter-layer peel ply between the opaque top material and the synthetic resin layer and the aforementioned synthetic resin layer is stuck to the postcard material by means of the adhesive layer, and the top material of the label can be peeled off with relative ease as it is stuck relatively weakly to the transparent synthetic resin layer where the inter-layer peel ply is formed, while the synthetic resin layer is stuck to the postcard material relatively strongly by the adhesion of the adhesive layer even after the top material of the label is peeled off.

According to the present invention, the synthetic resin layer is stuck to the postcard material by means of the adhesive layer relatively strongly, while the top material is stuck to the synthetic resin layer by means of the inter-layer peel ply relatively weakly and is stuck to the postcard material still weaker, hence the top material can be peeled off the postcard material. After the top material has been peeled off the postcard material, the secret information on the principal surface of the postcard material can be seen through the transparent part of the synthetic resin layer.

Moreover, by sticking the label without processing the postcard material, a postcard, which can be divided into the top material stuck weakly on the postcard material and the synthetic resin layer stuck completely, can be obtained, and the user is required only to do a simple peeling operation, thus making this type of postcard widely applicable.

The aforementioned objects and other objects, features and advantages of the present invention will become more apparent from reading of the detailed description of the embodiments given below with reference to the accompanying drawings.

BRIEF DESCRIPTION OF THE DRAWINGS

FIG. 4 and FIG. 5 are views showing a variation of the aforementioned embodiment, of which FIG. 4 is a sectional view and FIG. 5 is a partly broken-out perspective view.

DESCRIPTION OF THE PREFERRED EMBODIMENTS

Figure 1A:
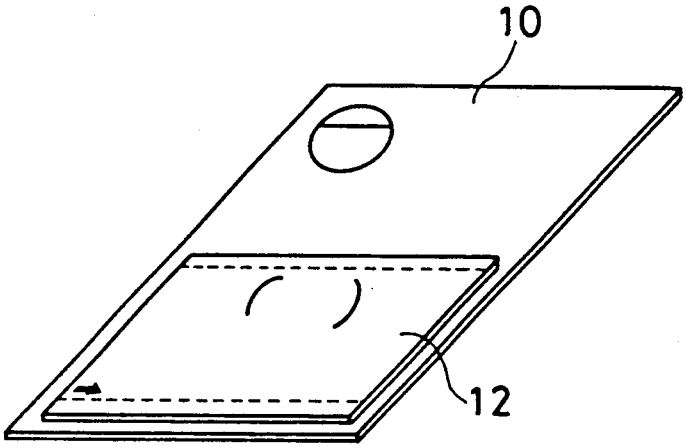
FIG. 1A and FIG. 1B are perspective views showing an embodiment of the present invention.
Figure 1B:
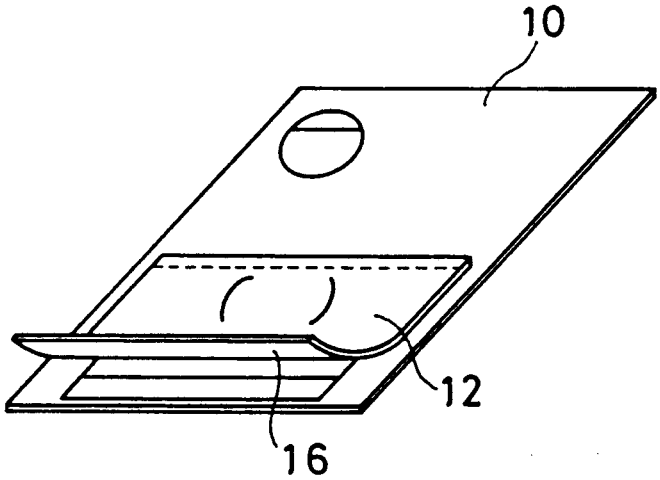

FIG. 1A and FIG. 1B are perspective views showing a postcard embodying the present invention.

Figure 2A:
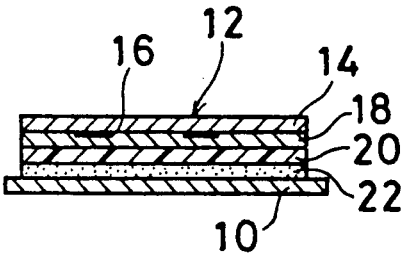
FIG. 2A and FIG. 2B are sectional views showing the above embodiment.
Figure 2B:
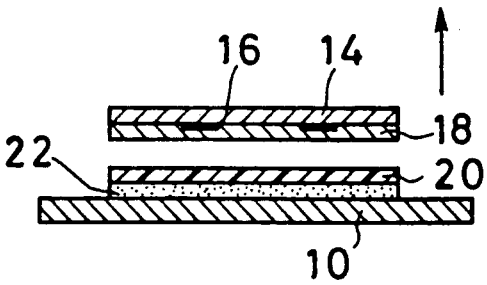

FIG. 2A and FIG. 2B are sectional views of the aforementioned embodiment.

This postcard includes a postcard material 10 of postcard size and a label 12 stuck to a part of the postcard material 10.

This label 12 includes a top material 14 formed of an opaque material.

This top material 14 is formed of a relatively soft material such as paper or a synthetic resin film.

This top material 14 is required to be opaque and have a suppressiveness which suppresses adhesion, that is, it resists adhesion. The top material 14 has to be made capable of covering by making it opaque by, for instance, printing it with a silver ink or the like to thereby form a suppression layer or laminating it with a film or foil having suppressiveness such as aluminum foil by the use of an adhesive or the like.

The surface of the suppression layer has formed therein a lottery part 16 wherein are shown letters such as "WINNING" or "BLANK".

The principal surface of the lottery part 16 of the aforementioned top material 14 is printed or coated with a wax to form an inter-layer peel ply 18, a part of which is made transparent so that the lottery part 16 can be see therethrough.

As the wax forming this inter-layer peel ply 18 may be used any of the animal, vegetable, mineral and petroleum-derived waxes, for instance, natural waxes such as paraffin wax, microcrystalline wax or petrolatum wax. Also usable are, among others, Fischer tropush wax and its derivatives, synthetic hydrocarbons such as low-molecular polyethylene and its derivatives, paraffin wax derivatives and microcrystalline wax derivatives, aliphatic alcohols and acids such as cetyl alcohol and stearic acid, fatty acid esters such as glyceryl stearate and polyethylene glycol stearate, hydrogenated waxes such as glyceride, castor wax and opal wax, synthetic ketone amine amides such as armor wax and acra wax and, further, chlorinated hydrocarbons, synthetic animal waxes, and synthetic waxes such as alphaolefin wax. It is also possible to use mixed waxes containing any of the aforementioned waxes.

On one principal surface of the inter-layer peel ply 18, there is formed a synthetic resin layer 20 which is at least partly transparent.

This synthetic resin layer 20 is formed by laminating a synthetic resin film or sheet on the top material 14 by the use of the adhesion of the aforementioned inter-layer peel ply 18 or by printing or coating a synthetic resin dissolved in a solvent or dispersed in water.

On the principal surface of the aforementioned synthetic resin layer 20, an adhesive layer 22 is formed by printing or coating an adhesive of the pressure sensitive type.

As the synthetic resin used for forming the aforementioned synthetic resin layer 20 may be used any of polyethylene, ethyleneethylacrylate copolymer resin, ethylene-acrylic acid copolymer resin, ethylene-methyl acrylate copolymer resin, ethylene-methylmethacrylate copolymer resin, ethylene-methacrylic acid copolymer resin, ionomer resin, polymethyl pentene resin, ethylene-vinyl alcohol copolymer resin, vinylidene chloride resin, vinyl chloride-vinyl acetate copolymer resin, polyamide resin, styrene-acrylic acid copolymer resin, polystyrene resin, polyacrylic acid copolymer resin, polyester resin, polyacrylic acid copolymer resin, polyester resin, and polyurethane resin. For printing or coating with any thereof, the selected synthetic resin may be dissolved in a proper solvent or dispersed in water.

Alternatively, lottery part 16 may be formed either on the surface of the aforementioned synthetic resin layer 20 or on the surface of the postcard material 10 to be visible through the synthetic resin layer 20. However, in such a case the synthetic resin layer 20 and the adhesive layer 22 have to be made transparent or translucent. The lottery part 16 may also be formed on the surface of the inter-layer peel ply 18, and in this case the inter-layer peel ply 18 need not be transparent or translucent.

Now, the method of manufacturing a postcard of this kind will be described.

Figure 3:
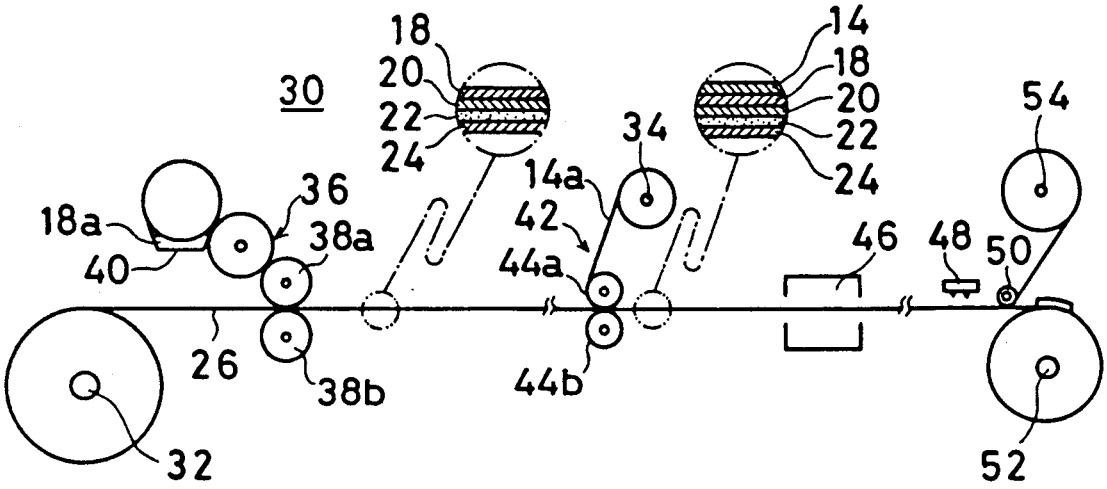
FIG. 3 is an illustrative view showing an example of the method of manufacturing the embodiment shown in FIG. 1.

First to be described is the method of manufacturing the label, referring mainly to FIG. 3.

To be prepared first is a piece of paper as the top material 14 and, if the suppressiveness of the paper is insufficient, either the principal surface thereof is solid-printed with a silver ink by a known printing method such as offset printing or by coating to thereby form a suppression layer. Alternatively, for formation of this suppression layer, an aluminum foil may be stuck to the principal surface of the paper using, for instance, an adhesive of the pressure-sensitive type and this paper-aluminum foil laminate may be used as top material 14. On the surface of this suppression layer the lottery part 16 is formed by printing or coating.

Meanwhile, a laminate 26 is prepared by laminating the synthetic resin film or sheet used for forming the synthetic resin layer 20 on the surface of a laminate with an adhesive layer 22 preformed thereon by application of an adhesive of the pressure sensitive type on the principal surface of a release sheet 24 coated with a release agent.

To the principal surface of this adhesive layer 22, the aforementioned release sheet 24 which plays a role of continuously supporting the label 21 divided into a plurality of parts, at the same time covering and protecting the adhesive layer 22, is temporarily stuck so that by the action of the release agent layer formed on the principal surface of the release sheet 24, the adhesive layer 22 can be easily peeled off the release sheet 24.

This laminate 26 in a rolled form is mounted on the holding roller 32 of manufacturing equipment 30 for the label. Meanwhile, the top material 14 also in a rolled form, is mounted on the holding roller 34 of the same equipment 30.

Then, one end of the rolled-up laminate 26 is pulled out and led into the coating apparatus 36.

This coating apparatus 36 is for coating the surface of the synthetic resin layer 20 with an inter-layer release agent such as wax agent 18*a* for formation of the inter-layer peel ply thereon, comprising two rollers 38*a* and 38*b* and also a storage vessel 40 and serves to apply by coating the heated and molten inter-layer release agent 18*a* with the rollers 38*a* and 38*b* being revolved.

As this coating apparatus 36, a coating machine such as a gravure roll coater or reverse roll coater may be used as well as a well-known printing machine such as an offset printing machine or screen printing machine.

Thus, the laminate 26 coated with the inter-layer release agent 18*a* is led into a laminating machine 42 for further lamination with the top material 14 as shown in FIG. 3.

The laminating machine 42 laminates paper 14*a* to serve as the top material 14 on the surface of the inter-layer release agent 18*a* on the laminate 26, is arranged on the path for the laminate 26, and includes a holding roller 34 for holding the top material 14 in roll form.

This paper 14*a* has one end pulled out and this is introduced between the roller 44*a* and the opposing roller 44*b*. Then, the laminate 26 coated with the inter-layer release agent 18*a* is led between the rollers 44*a* and 44*b*, hence between these rollers 44*a* and 44*b* the paper 14*a* is laid on the laminate 26 with the inter-layer release agent 18*a* in between. Thus, the laminate 26 with the paper 14*a* to serve as the top material 14 laid thereon is led through a cooler 46 or cooling roller (not shown).

The cooler 46 is for cooling the inter-layer release agent 18*a* applied between the laminate 26 and the paper 14*a*.

In the cooler 46, the inter-layer release agent 18*a* sandwiched between the laminate 26 and the paper 14*a* is cooled and solidified to form the inter-layer peel ply 18.

As mentioned above, the laminate further laminated with the top material 14 with the inter-layer peel ply 18 in between is led through a stamping unit 48. The stamping unit 48 includes a so-called die cutter, and by this die cutter proper cuts are made in the top material 14, inter-layer peel ply 18, synthetic resin layer 20 and adhesive layer 22. The stamping unit 48 may as well be of the type having an edged roll, the so-called die roll.

The laminate 26 further laminated with the top material 14 et cetera with cuts made therein is divided as it passes over a roller 50 between necessary and unnecessary parts and the unnecessary parts are wound round a waste take-up roller 52, while the label 12 temporarily stuck to the release sheet 24 is wound round a takeup roller 54.

Instead of the stamping unit 48 and the take-up roller 54, a cut-making unit may as well be used. This cut-making unit includes a cutting blade for making cuts in the top material 14, inter-layer peel ply 18, synthetic resin layer 20 and adhesive layer 22 so as to divide the label 12 into a plurality of parts.

Then, the label 12 in roll form is unrolled to pass through a label sticking unit in which it is stuck to the postcard material 10. The postcard material 10 may then be precut to official postcard size or the form of a continuous strip perforated properly. The secret information in letters or the like to be concealed by this label 12 such as the balance of a person's bank deposit is pre-printed, for example, near the bottom of its surface.

For sticking the label 12 to the postcard, for example, near its bottom, first the postcard material 10 is sent in successively. The rolled-up label 12 is then unrolled to be led to a release plate. By the use of the release plate, the label 12 and release sheet 24 are separated. The label 12 is stuck on the surface of the postcard material 10 by pressing the surface of the postcard material 10 after laying the label 12 on top of the postcard material 10.

When the postcard material 10 and the label 12 are pressed together, the label 12 is stuck strongly to the postcard material 10 by means of the adhesive layer 22, while the top material 14 is stuck weakly because of the presence of the inter-layer peel ply 18. Hence, as shown in FIG. 1B and FIG. 2B, the top material 14 of the label 12 can be peeled off the postcard material 10 with relative ease.

As examples of the top material 14 of the label 12 there can be cited, besides the one shown in the aforementioned embodiment, synthetic paper, films of cellophane, polyethylene, polyester, and the like or an aluminum foil, et cetera, but it is advisable to choose one relatively soft lest this label 12 stuck to the postcard material 10 should accidentally come off the postcard material 10 against the adhesion of the inter-layer peel ply 18.

When as the top material 14 what is excellent in suppressiveness such as aluminum foil has been selected, formation of a suppression layer such as in the aforementioned embodiment may be dispensed with.

Although in the aforementioned embodiment continuous paper in roll form was selected as the top material 14, it may as well be separated in sheet form.

The surface of the top material 14 may be printed in a mode suited for the postcard material 10, and when the top material 14, inter-layer peel ply 18 and synthetic resin layer 20 are formed to be continuous, marks for checking the feeding path of the label 12 such as black arrows may be printed as shown in FIG. 1A.

Figure 4:
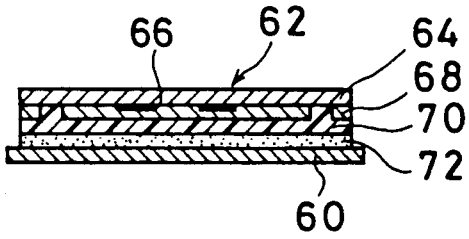

FIG. 4 is a view showing a postcard as a variation of the aforementioned embodiment.

As shown in FIG. 4, this postcard includes a postcard material 60 and a label 62 stuck to the surface of the postcard material 60, and the label 62 includes a top material 64, lottery part 66, inter-layer peel ply 68, transparent synthetic resin layer 70 and adhesive layer 72.

Figure 5:
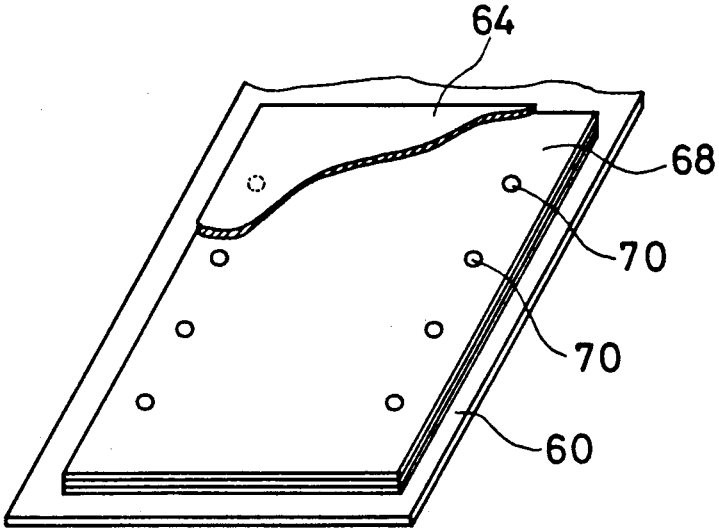

In this label 62, a part of the synthetic resin layer 70 is stuck directly to the top material 64 at spots, as shown in FIG. 5.

Hence, where the inter-layer peel ply 68 is not formed, the top material 64 is stuck to the synthetic resin layer 70 relatively strongly so that there is little risk of the top material 64 being accidentally peeled off the synthetic resin layer 70 even where the inter-layer peel ply 68 is present.

Now, described below is the method of manufacturing the label 62 illustrated in FIG. 4, referring mainly to FIG. 6 and FIG. 7.

Figure 6:
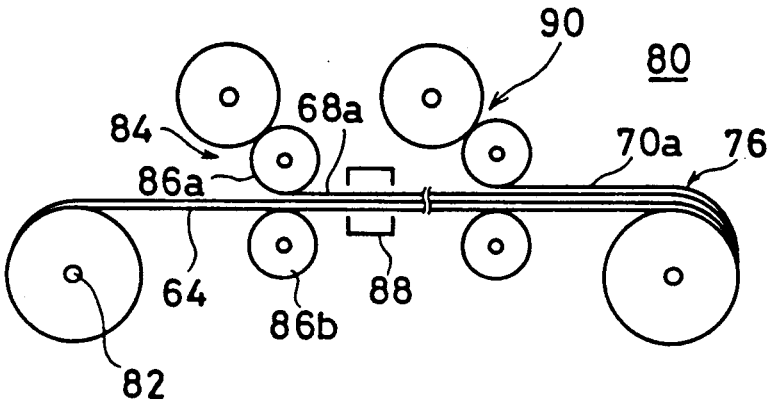
FIG. 6 and FIG. 7 are illustrative views showing an example of the manufacturing method for the embodiment shown in FIG. 4.

FIG. 6 is an illustrative view showing an example of manufacturing equipment for a laminate 76 formed by laminating the top material 64, inter-layer peel ply 68 and synthetic resin layer 70.

The illustrated manufacturing equipment 80 for this laminate 76 includes a holding roller 82 for holding the striplike top material 64 in roll form. The top material 64 held by the holding roller 82 has one thereof pulled out and this end is led into an inter-layer release agent coating unit 84.

This inter-layer release agent coating unit 84 is for printing or coating the surface of the top material 64 with an inter-layer release agent 68*a* such as wax, and includes two rollers 86*a* and 86*b*.

As the inter-layer release agent coating unit 84 may as well be used a coating machine of some other type or a known printing machine such as an offset printing machine or screen printing machine.

The top material 64 printed or coated with this inter-layer release agent 68*a* is then led through a drying unit 88 for solidification of the inter-layer release agent 68*a*.

The laminate with the inter-layer release agent 68*a* solidified on its surface in the drying unit 88 is then led through a synthetic resin coating unit 90 for formation of a transparent synthetic resin layer 70 thereon.

In this synthetic resin coating unit 90, the surface of the inter-layer peel ply 68 of a proper thickness formed by solidification of the aforementioned inter-layer release agent 68*a* is printed or coated with a synthetic resin agent 70*a* for formation of a synthetic resin layer 70 thereon.

The laminate 76 coated with the synthetic resin agent 70*a* in this synthetic resin coating unit is properly wound up in roll form after solidification of the synthetic resin agent 70*a*.

Figure 7:
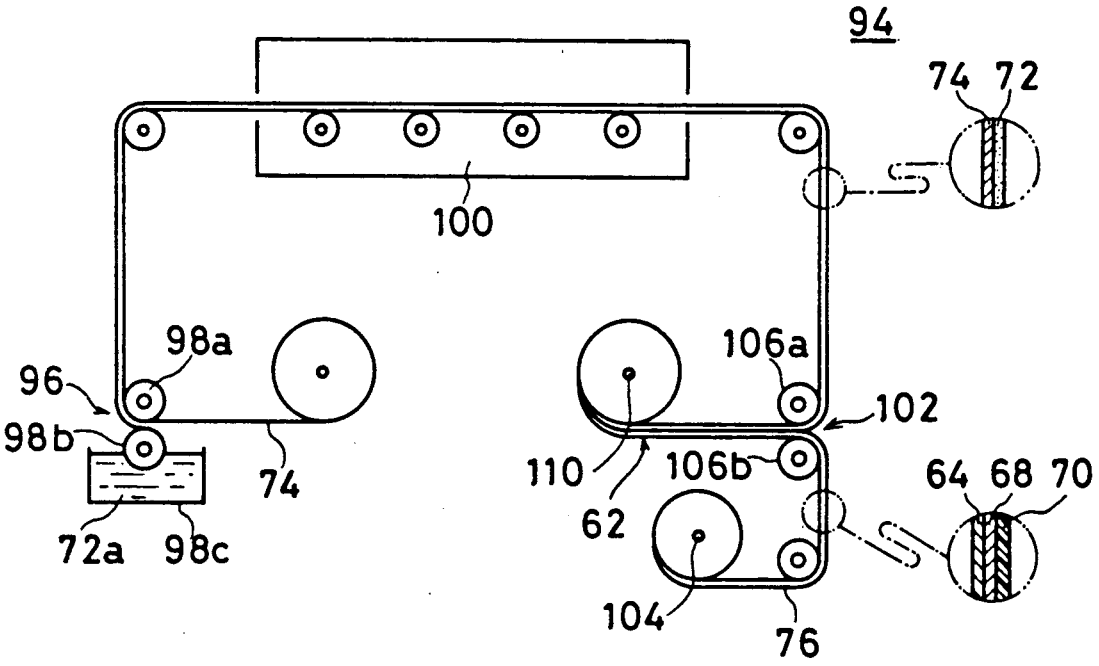

The laminate 76 wound up in roll form as shown in FIG. 7 is then loaded in a laminating unit 94 for formation of an adhesive layer 72.

In this laminating unit 94 a release sheet 74 is loaded in roll form, one end thereof is pulled out and is led into an adhesive coating unit 96 for having the surface of the release sheet 74 printed or coated with an adhesive 72*a* such as an adhesive of the pressure sensitive type.

The adhesive coating unit 96 includes two rollers 98*a* and 98*b*.

The roller 98*b* has its lower part kept dipped in the adhesive 72*a* in the bottom portion of a pan 98*c*. Hence when the rollers 98*a* and 98*b* are revolved, the surface of the release sheet 74 is printed or coated with the adhesive 72*a*. As this adhesive coating unit 96 may as well be used a coating machine of some other type or a printing machine of a known type such as an offset printing machine or screen printing machine.

The release sheet 74 thus printed or coated with the adhesive 72*a* is then led through a drying unit 100 including, for example, a heater. In the drying unit 100, the adhesive 72*a* applied to the surface of the release sheet 74 by printing or coating is dried to form the adhesive layer 72. The release sheet 74 with the adhesive layer 72 formed thereon is led into a laminating unit 102.

Meanwhile, the aforementioned laminate 76 is held in roll form on a separate holding roller 104, one end thereof is pulled out and this end is led into the laminating unit 102. The laminating unit 102 includes two rollers 106*a* and 106*b*. Between these two rollers 106*a* and 106*b*, the laminate of the release sheet 74 and the adhesive layer 72 is passed through together with the laminate 76 so that the synthetic resin layer 70 of the laminate 76 is stuck to and laminated on the adhesive layer 72. When these rollers 106*a* and 106*b* are revolved, the laminate of the adhesive layer 72, etc., and the synthetic resin layer 70 of the laminate 76 passing therethrough are stuck together and the label 62 is formed thereby.

The label 72 formed is wound round a take-up roller 110 to be kept in roll form.

When this is to be used, the roll may be unrolled and stamped in the desired shape as described above.

Figure 8A:
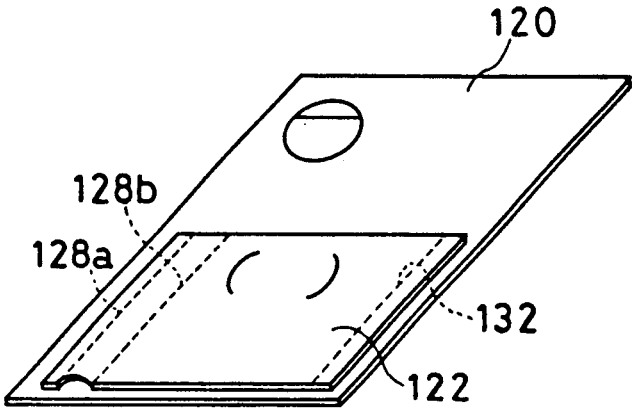
FIG. 8A and FIG. 8B are perspective views showing another embodiment.
Figure 8B:
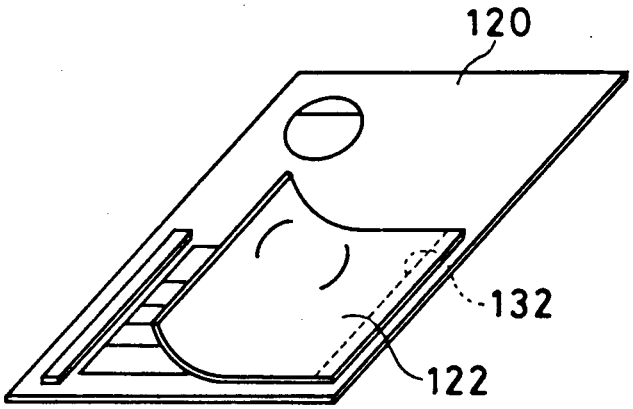
Figure 9A:
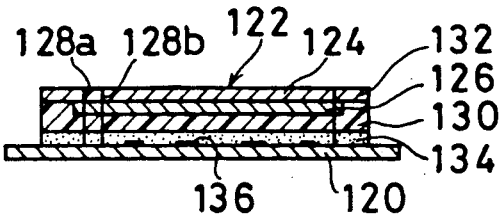
FIG. 9A and FIG. 9B are sectional views of the embodiment illustrated in FIG. 8A.
Figure 9B:
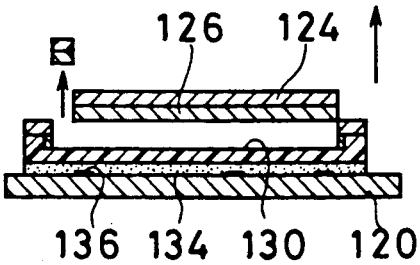

FIG. 8A and FIG. 8B are perspective views showing another embodiment, and FIG. 9A and FIG. 9B are sectional view of the embodiment shown in FIG. 8A.

FIG. 8A and FIG. 9A are views showing the original state, and FIG. 8B and FIG. 9B are views showing the released state.

In this embodiment, cuts 128*a* and 128*b* are made in a label 122 stuck to the postcard material 120, where the inter-layer peel ply 126 is formed, continuously from one end to the other end in parallel and in relative proximity in the vicinity of the left end of the top material 124 so as to allow parting of the top material 124. Moreover, the top material 124 between the cuts 128*a* and 128*b* is formed sunken to be easily caught by a finger or nail so that the top material 124 between the cuts 128*a* and 128*b* can be parted with ease. Alternatively, a projection may be provided at the fore end of the top material 124 between the cuts 128*a* and 128*b* to facilitate picking instead of the aforementioned sinking.

Also, in the vicinity of the right edge, a cut 132 for parting is provided so that the label 122 peeled off the postcard material 120 can be parted from the part securely stuck by means of the synthetic resin layer 130. In this embodiment a lottery part 136 is provided on the postcard material side 120 to be visible through the synthetic resin layer 130.

These cuts 128*a* and 128*b* as well as the cut 132 for parting are formed, when the top material 124 is made of paper, along the fiber direction so that the top material 124 can be parted with relative ease. In this embodiment, the synthetic resin layer 130 is directly stuck in the vicinities of both edges of the top material 124 lest it should be peeled off accidentally.

Figure 10:
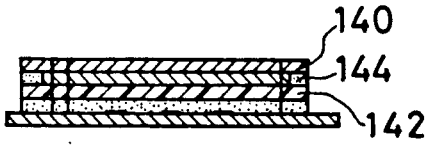
FIG. 10 is a sectional view showing a variation of the embodiment illustrated in FIG. 9A.
Figure 11:
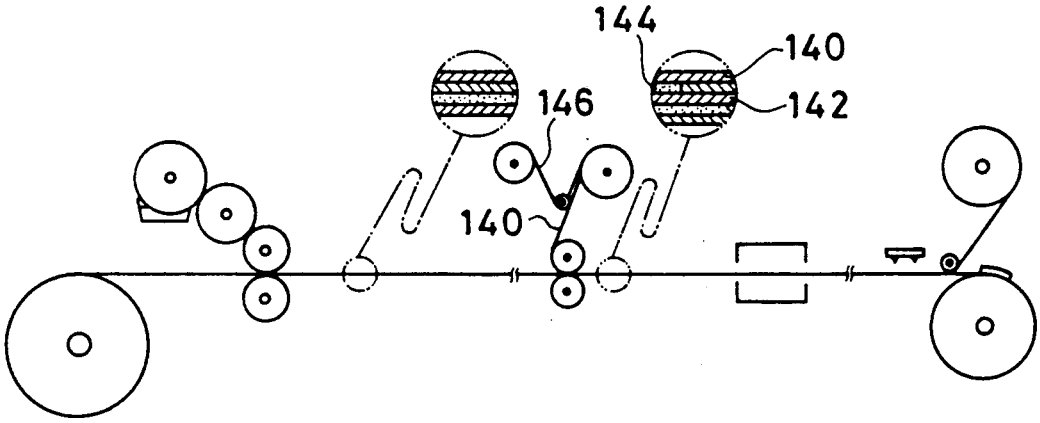
FIG. 11 is an illustrative view showing the method of manufacturing it.

FIG. 10 is a sectional view showing another variation of the embodiment shown in FIG. 9A, and FIG. 11 is an illustrative view showing the method of manufacturing it.

In this variation, a top material 140 and a synthetic resin layer 142 are strongly stuck together with an adhesive layer 144 in between.

As seen from FIG. 11, the method of manufacturing the postcard of this variation consists of steps of first forming an adhesive layer 144 on the surface of the top material 140 by printing or coating with an adhesive of the pressure sensitive type, then peeling off a release paper 146 and having it laminated on the surface of the synthetic resin layer 142.

Figure 12:
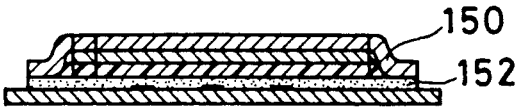
FIG. 12 is a view showing another variation thereof.

FIG. 12 is a view showing still another variation, in which a top material 150 and an adhesive layer 152 are directly stuck together to preclude accidental peeling off of the top material 150.

Figure 13:
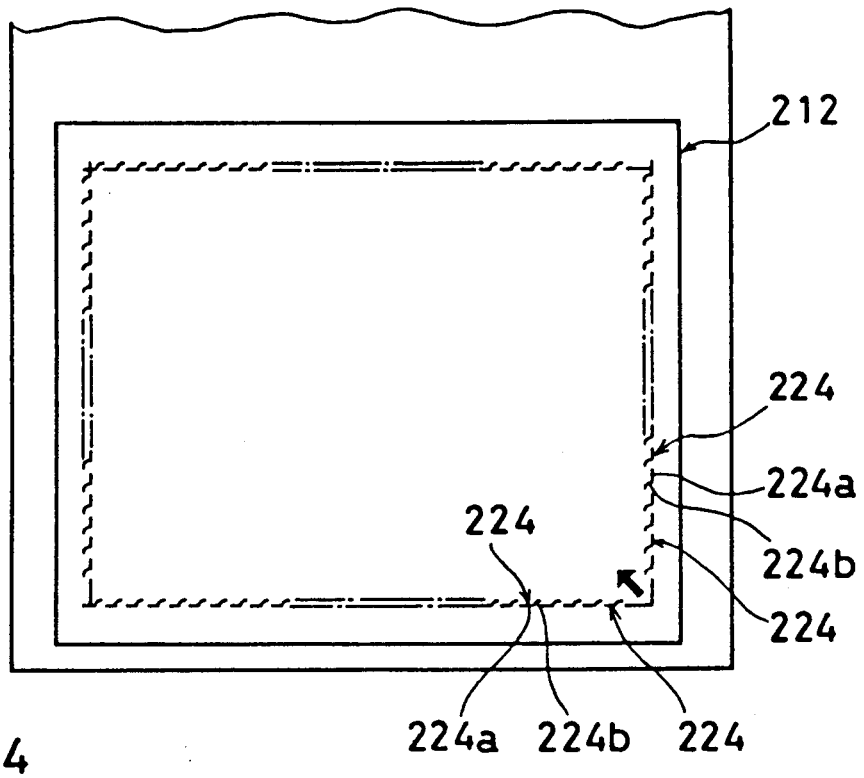
FIG. 13 is a partial plan view showing a separate embodiment of the invention.
Figure 14:
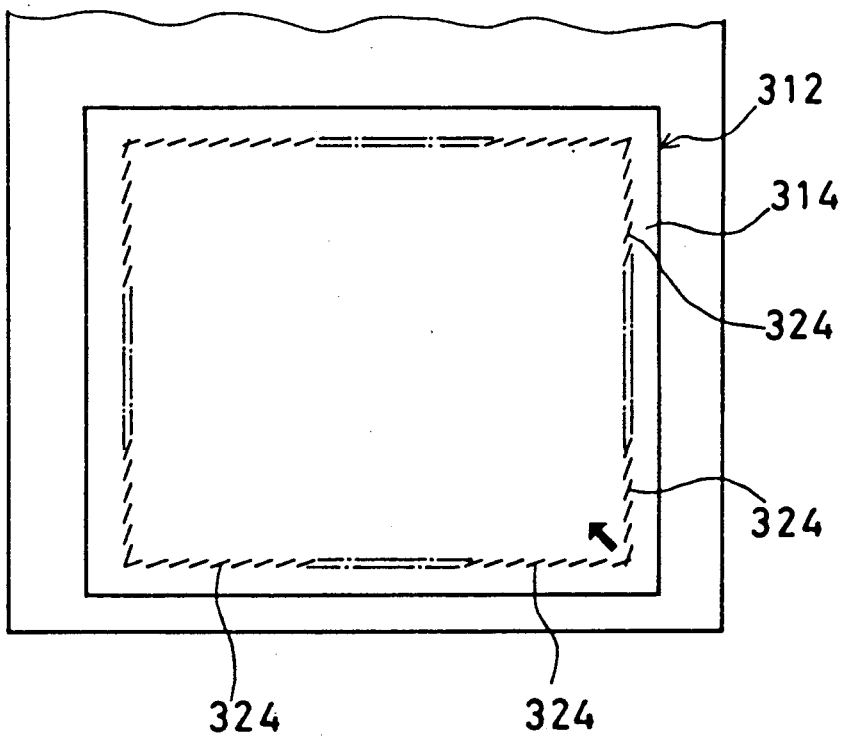
FIG. 14 is a partial plan view showing a modification of the embodiment of FIG. 13.

In each embodiment, the cuts may be formed along all edges of the top material. When the cuts are formed like that, the center portion of the label is peeled off easily. In this case, as shown in FIG. 13, when each cut is constituted with a linear cut portion and a curvilinear cut portion respectively so as to overlap a part of one cut 224 and a part of the next cut 224 in a direction for peeling the label 212, the center portion of the label 212 can be peeled off easily. In addition, for peeling off the center portion of the label easily, as shown in FIG. 14, for example, each linear cut 324 may be formed along edges of the top material 314 on a slant so as to overlap a part of one cut 324 and a part of the next cut 324 in a direction for peeling off the label 312.

It is to be understood that prior description and illustration made above are solely for the purpose of explanation and by no means limitation, and the spirit and scope of the present invention is limited only by the appended claims.

What is claimed is:

1. A postcard comprising a top material which is at least partially opaque, an inter-layer peel ply adhered to said top material, a synthetic resin layer which is at least partially transparent adhered to said inter-layer peel ply, a postcard material, indicia means on one side of said postcard material, an adhesive layer which is at least partially transparent adhered between said postcard material and said resin layer with said adhesive layer being in contact with said one side of said postcard material having said indicia means, said inter-layer peel ply comprising wax and being adhered to said resin layer with an adhering strength which is less than the adhering strength between said inter-layer peel ply and said top material, less than the adhering strength between said resin layer and said adhesive layer, and less than the adhering strength between said adhesive layer and said postcard material, said top material and inter-layer peel ply being peelable off of said resin layer as separation occurs between said inter-layer peel ply and said resin layer, said indicia means on said postcard material being viewable through said transparent resin layer and said transparent adhesive layer after said opaque top material and said inter-layer peel ply have been peeled off of said resin layer.

2. A postcard comprising a top material which is at least partly opaque, an inter-layer peel ply comprising wax adhered to said top material, said inter-layer peel ply having a plurality of openings, a synthetic resin layer which is at least partially transparent adhered to said inter-layer peel ply, a postcard material and an adhesive layer which is at least partly transparent adhered between said postcard material and said resin layer, said resin layer having spaced projections extending into said openings and adhered to said top material, said inter-layer peel ply being adhered to said resin layer with an adhering strength which is less than the adhering strength between said inter-layer peel ply and said top material, less than the adhering strength between said resin layer and said adhesive layer, and less than the adhering strength between said adhesive layer and said postcard material, said projections on said resin layer adhering to said top material with an adhering strength greater than the adhering strength between said inter-layer peel ply and said top material, said top material and said inter-peel ply being peelable off of said resin layer as separation occurs between said inter-layer peel ply and said resin layer with said adherence between said projections and said top material providing an additional adherence to preclude inadvertent and unintended removal of said top material from said postcard material.

3. A postcard according to claim 2, wherein said adhesive layer is adhered to one side of said postcard material, and further comprising indicia means on said one side of said postcard material, said indicia means on said postcard material being viewable through said transparent adhesive layer and resin layer after said opaque top material and said inter-layer peel ply have been peeled off of said resin layer.

* * * * *